US005135372A

United States Patent [19]

Pipalov

[11] Patent Number: 5,135,372

[45] Date of Patent: Aug. 4, 1992

[54] MULTICAM AND MULTICHAMBER FLUID MACHINE WITH ROTARY POSITIVE SLIDING SEALS

[76] Inventor: Aleksander G. Pipalov, 12300 Sherman Wy. #176, No. Hollywood, Calif. 91605

[21] Appl. No.: 728,013

[22] Filed: Jul. 8, 1991

Related U.S. Application Data

[63] Continuation of Ser. No. 271,357, Nov. 10, 1988, abandoned, which is a continuation of Ser. No. 36,712, Apr. 9, 1987, abandoned.

[51] Int. Cl.[5] ..... F01C 1/344; F01C 1/356

[52] U.S. Cl. ..... 418/173; 418/177

[58] Field of Search ..... 418/177, 174, 22, 28, 418/6, 173, 175

[56] References Cited

U.S. PATENT DOCUMENTS

| | | | |
|---|---|---|---|
| 888,779 | 5/1908 | Berrenberg | 418/46 |
| 1,518,812 | 12/1924 | Olson | 418/177 X |
| 1,923,561 | 8/1933 | Winckler | 418/177 |
| 2,099,193 | 11/1937 | Brightwell | 418/177 |
| 2,990,109 | 6/1961 | Fraser | 418/6 |
| 4,551,080 | 11/1985 | Geiger | 418/28 |

FOREIGN PATENT DOCUMENTS

| | | | |
|---|---|---|---|
| 516295 | 1/1953 | Belgium | 418/174 |

*Primary Examiner*—John J. Vrablik
*Attorney, Agent, or Firm*—Koda and Androlia

[57] ABSTRACT

A rotary fluid machine including a plurality of fluid chambers defined by a housing and a rotor and by a plurality of lobes and seals engaging with the lobes provided on the housing and the rotor with the number of seals and lobes being unequal and fluid passageways provided in each of the plurality of chambers with alternate fluid passageways being connected together.

7 Claims, 11 Drawing Sheets

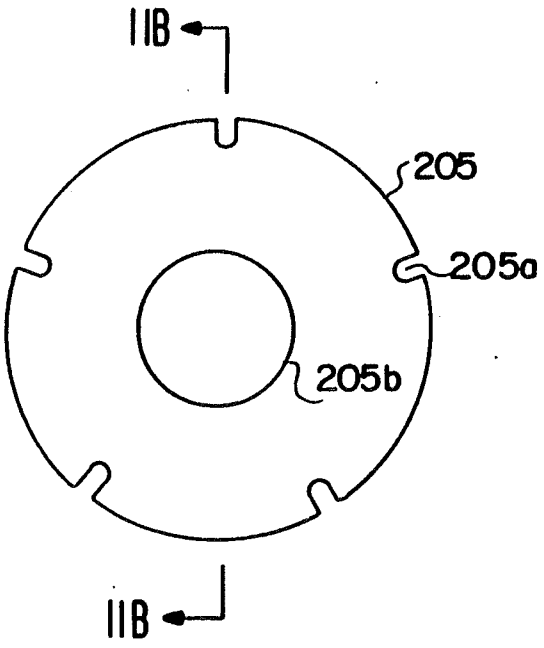
FIG. IIA
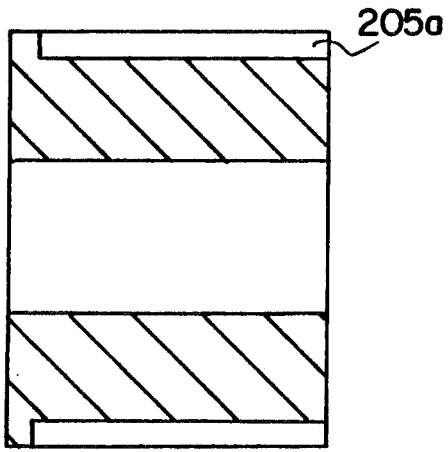
FIG. IIB

MULTICAM AND MULTICHAMBER FLUID MACHINE WITH ROTARY POSITIVE SLIDING SEALS

This is a continuation of application Ser. No. 271,357, filed Nov. 10, 1988 now abandoned, which is a continuation of application Ser. No. 036,712, filed Apr. 9, 1987, now abandoned.

BACKGROUND OF THE INVENTION

1. Field of the Invention

This device relates to rotary fluid machines and more particularly, to rotary fluid pumps and rotary fluid motors.

2. Prior Art

In the prior art there exist rotary fluid pumps and rotary fluid motors. Such pumps and motors employ rotors which revolve within a chamber provided in a housing; however, such fluid motors or pumps suffer from certain disadvantages. In particular, they are very inefficient in either converting the fluid pressure into the rotary motion of the rotor or in converting the rotary power applied to the rotor into the pressurized fluid. The primary reason for inefficiency is the fact that in such prior art rotary fluid pumps and motors, fluid is either injected into or taken out of only one chamber of the pump or motor at a time. Furthermore, the prior art rotary machines use only a half of the useful area of the vanes during operation and the force of the pressurized fluid does not act tangentially on the rotor. As a result, the majority of the working surface of the fluid pump or motor is unused at any given moment in time. In addition, most of the prior art rotary machines only provide inlet and outlet passages on the rotor which results in a sealing problem.

Representative examples of such prior art rotary fluid motors and pumps are shown in the following United States patents:

| | |
|---|---|
| 87,023 | 8,592,570 |
| 2,366,213 | 3,797,464 |
| 2,409,141 | 4,089,305 |
| 2,583,633 | 4,127,094 |
| 3,584,984 | |

SUMMARY OF THE INVENTION

Accordingly, it is a general object of the present invention to provide a rotary fluid machine which is more efficient than that provided by the prior art.

It is another object of the present invention to provide a rotary fluid machine which is simple to manufacture and assemble.

It is still another object of the present invention to provide a rotary fluid machine which is capable of variable fluid flow when used as a pump and variable rotary speeds and torque when utilized as a motor.

In keeping with the principles of the present invention, the objects are accomplished by a unique rotary fluid machine which includes a plurality of fluid chambers defined by a housing and a rotor provided in the housing. A plurality of lobes and seals which engage with the lobes are provided on the housing and rotor, the number of seals being different than the number of lobes. At least one fluid communicating means is provided in each of the plurality of chambers with alternate fluid communicating means coupled together.

With the above construction, it is possible to provide a highly efficient rotary fluid pump or rotary fluid motor which is simple to manufacture and assemble.

BRIEF DESCRIPTION OF THE DRAWINGS

The above-mentioned features and objects of the present invention will become more apparent with reference to the following description taken in conjunction with the accompanying drawings wherein like reference numerals denote like elements and in which:

FIG. 11A is a front view of a seal plug utilized in the variable rotary fluid machine of FIG. 9 and FIG. 11B is a cross-sectional view of FIG. 11A along the line B—B.

DETAILED DESCRIPTION OF THE INVENTION

Figure 1:
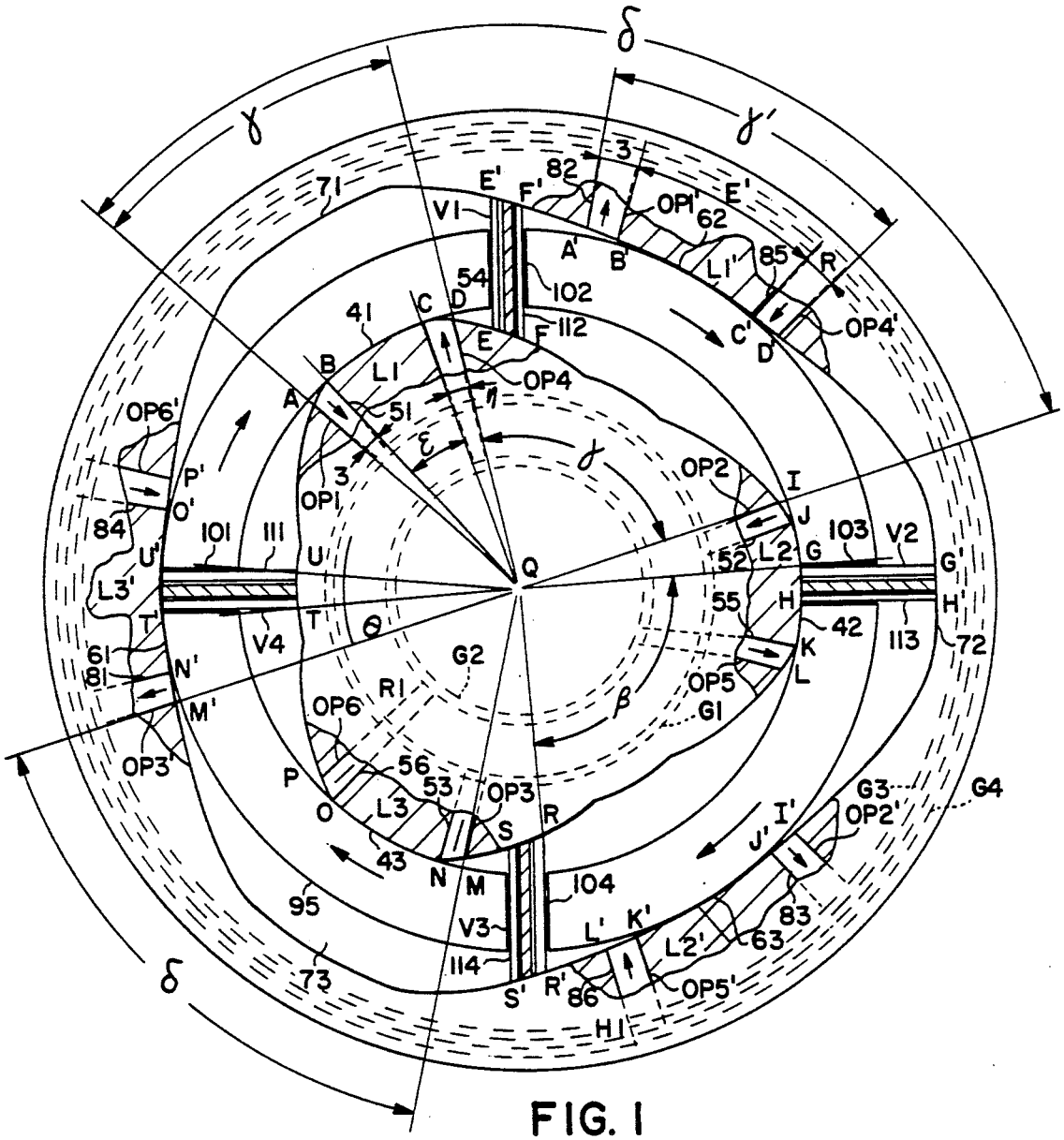
FIG. 1 is a cross-sectional view of a rotary fluid machine in accordance with the teachings of the present invention.
Figure 2:
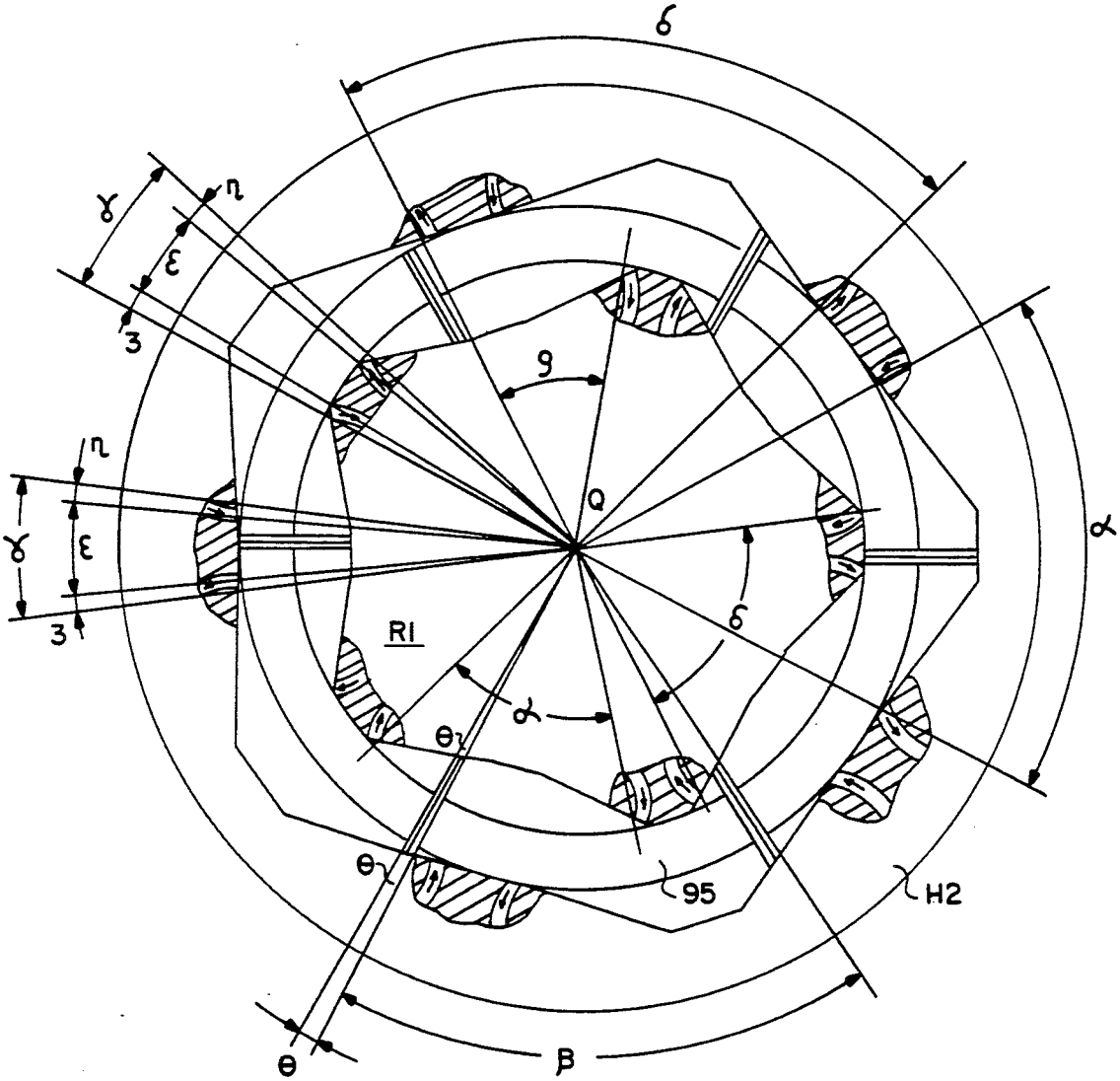
FIG. 2 is a cross-sectional view of a second embodiment of a rotary fluid machine in accordance with the teachings of the present invention.
Figure 3:
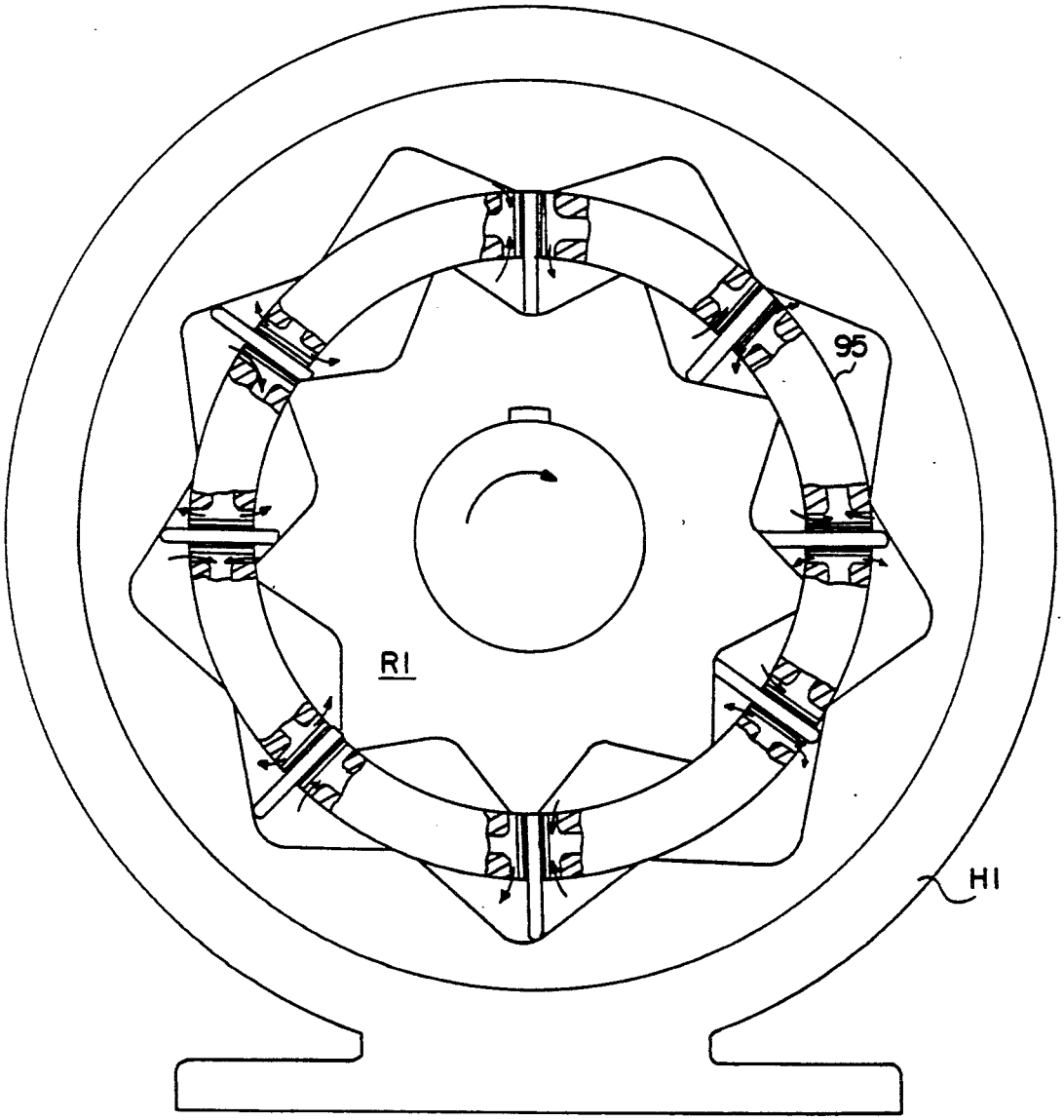
FIG. 3 is a cross-sectional view of a third embodiment of a rotary fluid machine in accordance with the teachings of the present invention.
Figure 4:
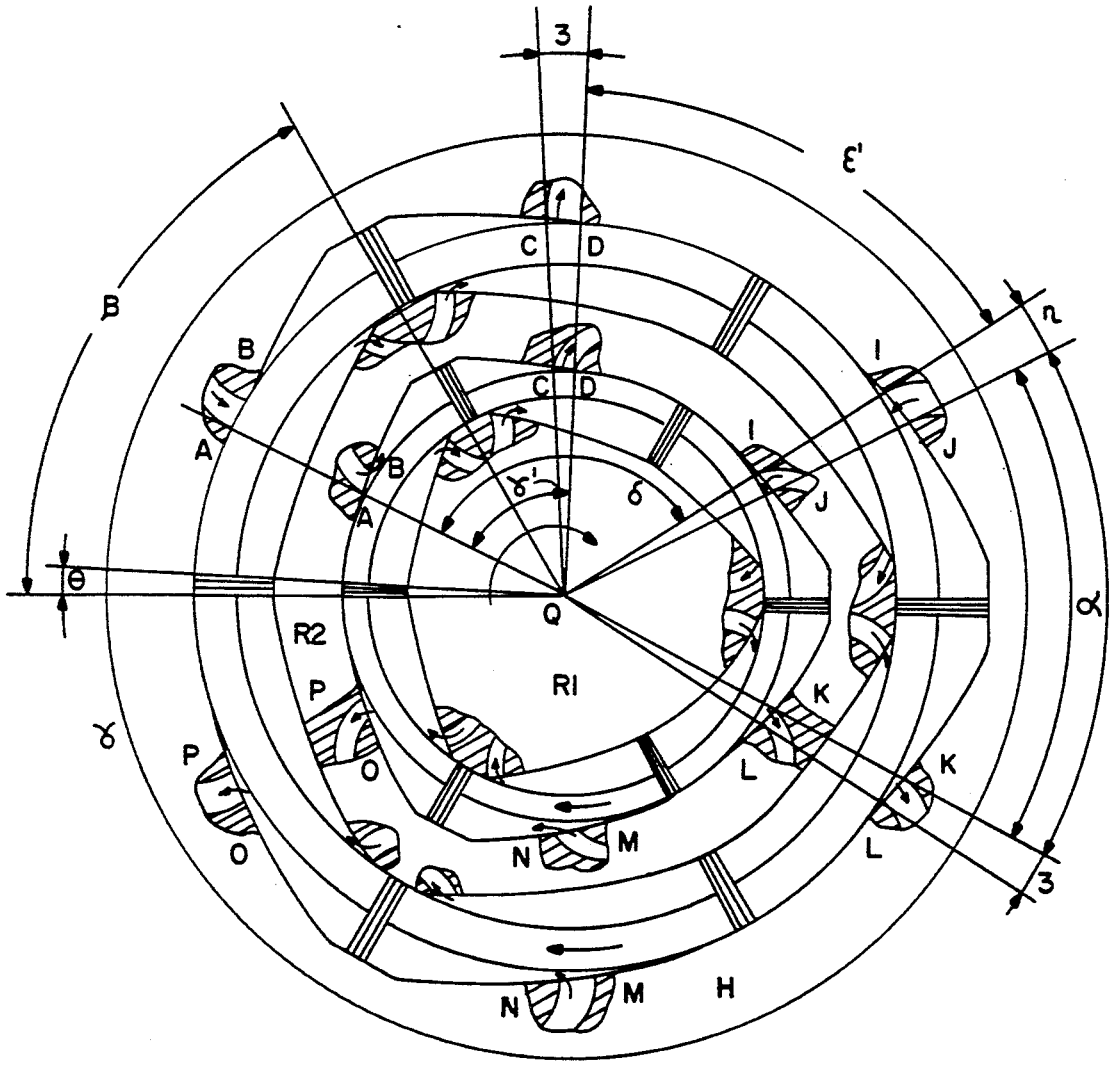
FIG. 4 is a cross-sectional view of a fourth embodiment of a rotary fluid machine in accordance with the teachings of the present invention.

Referring particularly to the Figures, shown in FIG. 1 is a rotary fluid machine in accordance with the teachings of the present invention. The rotary fluid machine generally comprises a housing H1 and a rotor R1. The rotor R1 and housing H1 are provided respectively with equally spaced, radially extending lobes L1, L2 and L3 and lobes L1', L2' and L3' with the same angle provided between them. Passage openings OP1 and OP4 are provided on each side of the peak of lobe L1, passage openings OP2 and OP5 are provided on each side of the peak of lobe L2 and passage openings OP3 and OP6 are provided on each side of the peak of lobe L3. Similarly, passage openings OP1', OP4', OP2', OP3' and OP6' are provided in lobes L1', L2' and L3'. Fluid passageway openings OP1, OP2 and OP3 are in fluid connection with groove G1 provided in the rotor R1. The fluid passage openings OP4, OP5 and OP6 are in fluid connection with the groove G2 which is also provided in the rotor R1. Similarly, fluid passageway openings OP1', OP2' and OP3' and OP4', OP5' and OP6' are respectively in fluid connection with the grooves G3 and G4 in housing H1. Seals V1, V2, V3 and V4 are provided in a ring 95 which is provided between the rotor R1 and housing H1 and are equally spaced in a radial direction around the ring 95.

The points A, B, C, D, I, J, K, L, M, N, O and P are the edges of the openings OP1, OP4, OP2, OP5, OP3 and OP6. The cords EF, GH, RS and TU and E'F', G'H', R'S' and T'U' are the sealing zones respectively for the seals V1–V4 on the surface of the rotor R1 and the housing H1.

For the sake of convenience, certain terms which will be used in the following description and equations will now be described. In addition, the notation " XYZ" means the angle defined by the points X, Y, Z.

1) $\measuredangle DQI = \measuredangle LQM = \measuredangle PQA = \alpha$
2) $\measuredangle EQG = \measuredangle GQR = \measuredangle RQT = \measuredangle TQE = \beta$
3) $\measuredangle AQD = \measuredangle IQL = \measuredangle MQP = \gamma$
4) $\measuredangle AQI = \measuredangle A'QI' = \measuredangle MQA = \measuredangle IQM = \measuredangle I'QM' = \measuredangle M'QA' = \delta$
5) $\measuredangle BQC = \measuredangle JQK = \measuredangle NQO = \epsilon$
6) $\measuredangle AQB = \measuredangle IQJ = \measuredangle MQN = \xi = \measuredangle A'QB' = \measuredangle I'QJ' = \measuredangle M'QN'$
7) $\measuredangle CQD = \measuredangle KQL = \measuredangle OQP = \eta = \measuredangle C'QD' = \measuredangle K'QL' = \measuredangle O'QP'$
8) $\measuredangle D'QI' = \measuredangle L'QM' = \measuredangle P'QA' = \alpha'$
9) $Z_L$=the number of lobes of the rotor;
10) $Z_V$=the number of seals;
11) $\measuredangle TQZ = \measuredangle FQF = \measuredangle GQH = \measuredangle RQS = \theta$
12) $\measuredangle B'QC' = \measuredangle J'QK' = \measuredangle N'QO' = \measuredangle \epsilon'$
13) $\measuredangle A'QD' = \measuredangle I'QL' = \measuredangle M'QP' = \measuredangle \gamma'$
14) $\measuredangle AQA' = \measuredangle BQB' = \measuredangle CQC' = \measuredangle DQD' = \measuredangle IQI' = \measuredangle JQJ' = \measuredangle RQR' = \measuredangle LQL' = \measuredangle MQM' = \measuredangle NQN' = \measuredangle OQO' = \measuredangle PQP' = \delta$ With the above in mind, the equations for defining the structure shown in FIG. 1 will now be discussed. In particular, the number of seals $Z_V$ is always greater than the number of lobes $Z_L+1$ and is defined by Equation (15). The pitch of the seals $\beta$ is defined by Equation (16). The pitch of the lobes $\delta$ is defined by Equation (17). The opening angle of the edges and the distance between them is defined by Equation (18). The pitch of the lobes $\delta$ is further defined by Equation (19). The angles of the openings and the angle of the sealing zone of the seals V1–V4 are defined by Equations (20) and (21). The pitch of the seals is defined by the Equation (22). The sealing zone of the seals is further defined from the Equation (23). The angular distance between the edges of two openings of lobes L1–L3 is defined by the Equation (24). From Equations (16) and (17), Equation (25) can be derived. From Equations (18) and (19), Equation (26) can be derived. From Equations (17), (18) and (19), Equation (27) can be derived. From Equations (15), (16) and (17), Equation (28) can be derived. From Equations (20), (21) and (22), if $\mu=0$ and $\gamma=0$, Equation (29) can be derived.

$$Z_v \geqq Z_L + 1 \quad (15)$$

$$\beta = \frac{360°}{Z_v} \quad (16)$$

$$\delta = \frac{360°}{Z_L} \quad (17)$$

$$3 + \epsilon + \eta = \gamma \quad (18)$$

$$\delta = \alpha + 3 + \epsilon + \eta \quad (19)$$

-continued $$\mu = \eta - \theta \quad (20)$$

$$y = \eta - 3 \quad (21)$$

$$\beta \leqq \alpha + 3 + y - \mu \quad (22)$$

$$\theta = 3 + y - \mu \quad (23)$$

$$0 < \epsilon \leqq \alpha \quad (24)$$

$$\beta x Z_v = \delta x Z_L \quad (25)$$

$$\delta = \alpha + \gamma \quad (26)$$

$$\frac{360°}{Z_L} = \alpha + 3 + \epsilon + \eta = \alpha + \gamma \quad (27)$$

$$\frac{360°}{\beta} = \frac{360°}{\delta} + 1 \quad (28)$$

$$\text{If: } \mu = 0 \quad y = 0 \quad 3 = \eta = \theta \quad (29)$$

$$\measuredangle \rho = \frac{\delta}{2} = \frac{\alpha + \gamma}{2} \quad (30)$$

$$\epsilon = \epsilon' \quad (31)$$

$$\alpha = \alpha' \quad (32)$$

$$\gamma = \gamma' \quad (33)$$

In accordance with the general description and equations given above, a rotary fluid machine can be constructed having a simple structure and which is highly efficient. The operation of the rotary fluid machine provided by the present invention is described below.

For the sake of simplicity of description, the parts previously defined above with letters will be given reference numbers and a description of their interconnection and operation is as follows.

In FIG. 1 the rotor R1 is provided with a plurality of lobes 41–43. Each of the lobes 41–43 is provided with a pair of fluid passageway openings 51–56. The fluid passageway openings 51–53 are connected together by a groove G1 which is provided in the rotor R1. Similarly, the fluid passage openings 54–56 are connected together by means of a groove G2 which is also provided in the rotor R1. A housing H1 surrounds the rotor R1; however, instead of the lobes of the rotor R1 sealing against the inside circular surface of the housing H1, the inside surface of the housing H1 is shaped similarly in configuration to the surface of the rotor R1, except that it is slightly larger in scale. As a result, the inside of the housing H1 is provided with lobes 61–63 and nodes 71–73. A plurality of fluid passage openings 81–86 are provided in the lobes 61–63 of the housing H1. Fluid passage openings 81–83 are connected together by a groove or passage G3 provided in the housing H1 and similarly, the fluid passage openings 84–86 are connected together by a grove or fluid passage G4 provided in the housing H1.

A ring 95 is provided between the rotor R1 and the inner surface of the housing H1 and completely surrounds the rotor R1 and separates it from the inner surface of the housing H1. The inner surface of the ring 95 is at a radius which is substantially equal to the major radius of the rotor R1 and as a result, the lobes 41–43 form a seal with the inner surface of the ring 95. The outer surface of the ring 95 is of a radius which is equal to the minor radius of the inner surface of the housing H1 and as a result, the lobes 61–63 form a seal with the outer surface of the ring 95. The ring 95 is further provided with a plurality of slots 101–104. Through these slots 101–104, rectangular seals 111–114 movably extend in both directions and each of the seals 111 through 114 is made up of a plurality of mutually slidable thin plates as is shown in FIG. 1. As previously stated, the seals 111–114 are provided at the same angular relationship as the seals V1–V4 previously discussed. The height of the seals is further adjusted to substantially be equal to the perpendicular distance between the outer surface of the rotor R1 and the inner surface of the housing H1 but each of the seals 111–114 is of a non-rectangular shape and a length of a diagonal line defined by two opposite sealing points on each of the seals is set such that it is equal to a radial distance of the inner rotor R1 and an inner surface of the housing H1. In this way, the alternate ends of the seals 111–114 form a seal with the outer surface of rotor R1 and the inner surface of the housing H1.

In operation, if the rotor R1 and the housing H1 are connected together and pressurized fluid is injected into the fluid passage openings 54–56 in the rotor R1 and 84–86 in the housing H1, the ring 95 would start to rotate. Since the total surface area upon which the fluid is now acting is double than that of prior art devices, the efficiency is substantially greater than the prior art.

It should also be apparent that the shape of the rotor R1, the inner surface of the housing H1 and the ring 95 could be reversed. Also, the location of fluid passage openings could be provided on the rotor R1 and the housing H1 or in the ring 95. In addition, the lobes could be provided axially as well as radially. Furthermore, the rotary fluid motor could be reversed in direction or braked by reversing the fluid passage openings to which the pressurized fluid is applied. In addition, the efficiency of the embodiment of FIG. 1 could be increased by increasing the number of rings and by making the alternative rings, i.e. the second, fourth, etc. rings from the rotor, of the same inner and outer shape as the outer surface of the rotor. In this way, the efficiency of the rotary fluid machine could be increased by increasing the size. Also, the number of lobes on the rotor R1 and housing H1 could be increased.

Figure 5:
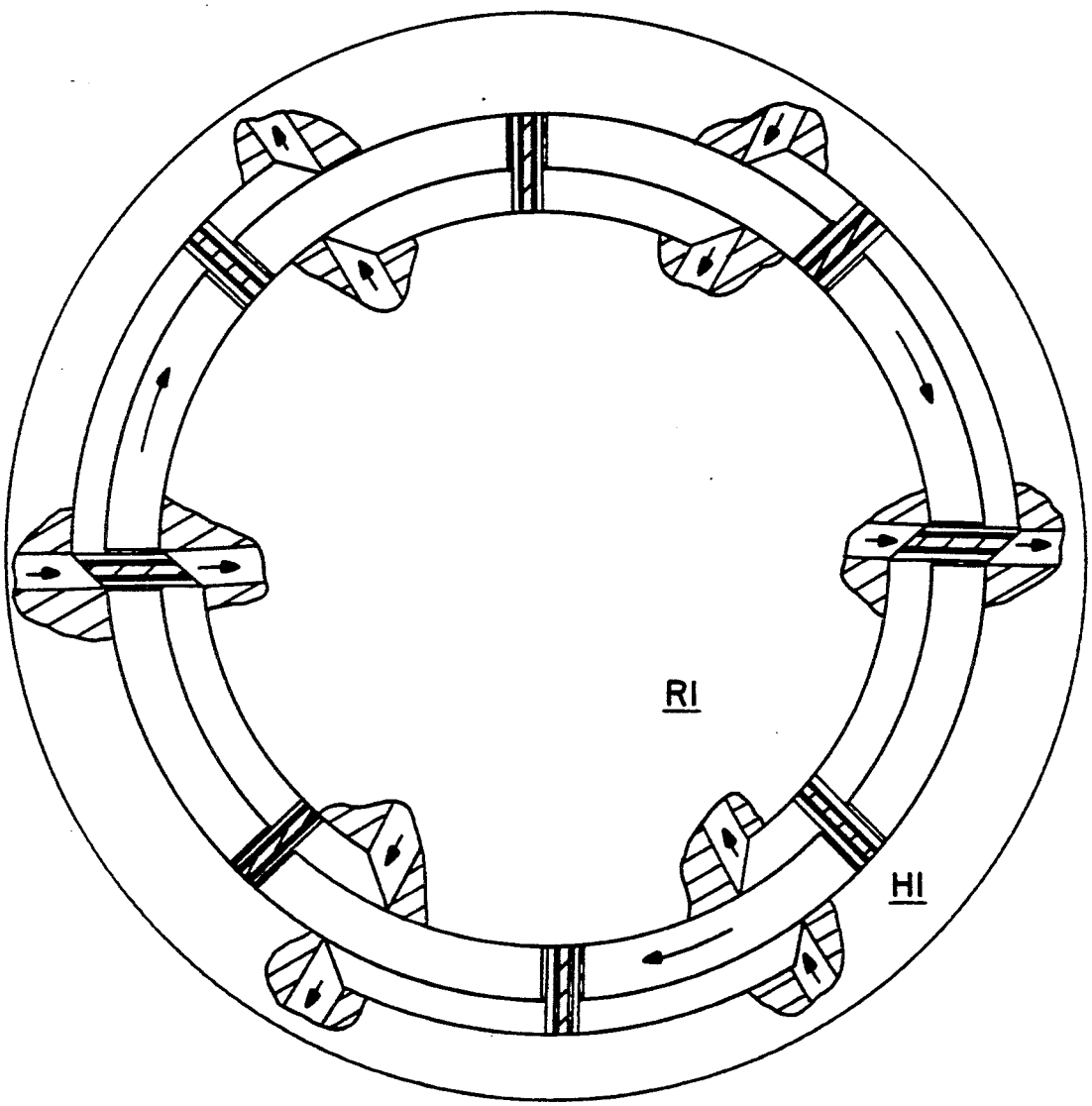
FIG. 5 is a cross-sectional view of a fifth embodiment of a rotary fluid machine in accordance with the teachings of the present invention.

Referring to FIGS. 2 through 5, shown therein are constructions which embody the variations mentioned above. In particular, in the construction shown in FIG. 2, the number of lobes provided in the rotor and the housing is increased to five instead of the three lobes shown in FIG. 1. In the construction shown in FIG. 3, not only is the number of lobes in the rotor and housing increased up to nine, but also the fluid passage openings for the chambers formed between the outer surface of the ring and the inner surface of housing and the chambers formed between the inner surface of the ring and the outer surface of the rotor are all provided in the ring. As can be seen in the construction shown in FIG. 4, the number of rings has been doubled to two and the second rotor R2 also functions as a housing on its inner surface, while acting as a rotor on its outer surface. Referring to FIG. 5, shown therein is a construction wherein the shape of the lobes provided on the rotor and on the housing are different. In particular, in this embodiment the lobes are somewhat rectangular with sloping side surfaces and the fluid passage openings are provided in the sloping surfaces of the lobes.

While the constructions described above are more efficient, it should be apparent that simplier constructions could be devised by eliminating the ring and allowing the rotor to directly contact an inner surface of the housing. In such a construction, the seals would be provided either equally about the housing or would be provided in the rotor.

Figure 6:
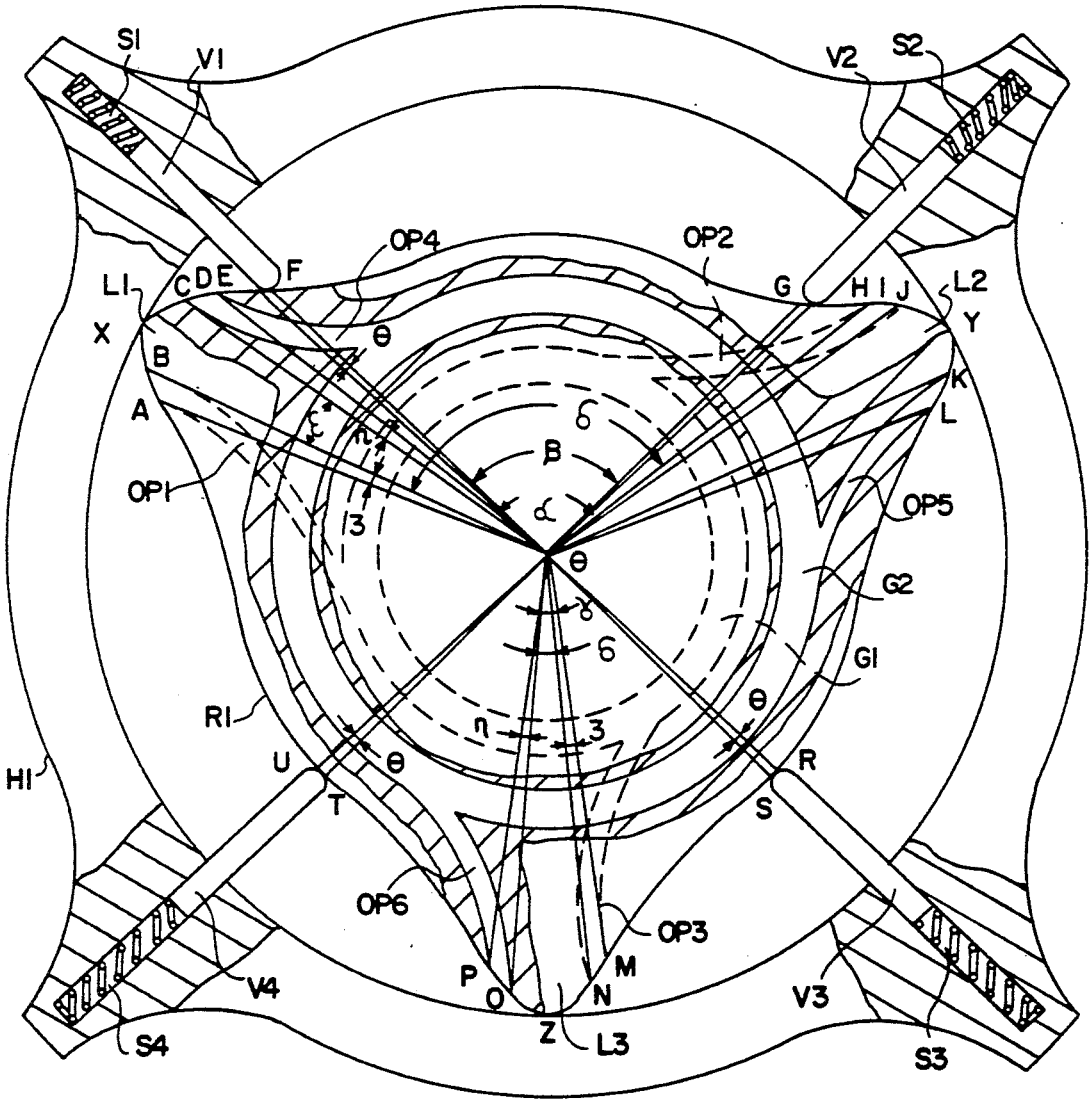
FIG. 6 is a cross-sectional view of a sixth embodiment of a rotary fluid machine in accordance with the teachings of the present invention.

Referring to the embodiment shown in FIG. 6, shown therein is a construction wherein the ring has been removed. In this embodiment those elements with a similar purpose and construction to those shown in FIG. 1 are given like reference numerals. In addition, the lobes L1–L3 contact the inner surface of the housing H1 at points X, Y and Z. A description of the operation of the embodiment shown in FIG. 6 is given below.

In operation, the sealing points XYZ form a seal with the inner surface of the housing H1. The seals V1–V4 are pressed into engagement with the outer surface of the rotor R1 and form a plurality of seals therewith. As a result, a plurality of chambers are formed by the lobes L1–L4 of the rotor R1 and the seals V1–V4 provided on the rotor R1 and the housing H1. If a fluid under pressure is supplied to the groove G1, this pressurized fluid will be supplied to various ones of the plurality of chambers by the fluid passage openings OP1, OP2 and OP3. As a result, those chambers of the plurality of chambers which are supplied with the pressurized fluid will tend to increase in size due to pressure build-up within each chamber. The tendency of these chambers to increase in size will cause the rotor R1 to rotate. As the rotor R1 rotates, those chambers supplied with the pressurized fluid will continue to increase in size and those chambers which are not supplied with pressurized fluid will decrease in size. Thus, the fluid therein will be expelled via the passage openings OP4, OP5 and OP6 through groove G2 to a fluid reservior. In this way, a rotary fluid motor is provided.

It should be apparent from the above description that since the pressurized fluid is applied in more than one chamber at a time and acts against a greater surface area of the rotary fluid machine than in prior art rotary fluid machines, the efficiency of the present invention will be higher than prior art devices. It should further be apparent that by applying rotary motion to the rotor R1 and by connecting a source of fluid to groove G1, fluid can be alternately drawn into and forced out of the openings OP1, OP2 and OP3 and OP4, OP5, and OP6 so that the rotary fluid machine shown in FIG. 1 can function as a pump.

Figure 7:
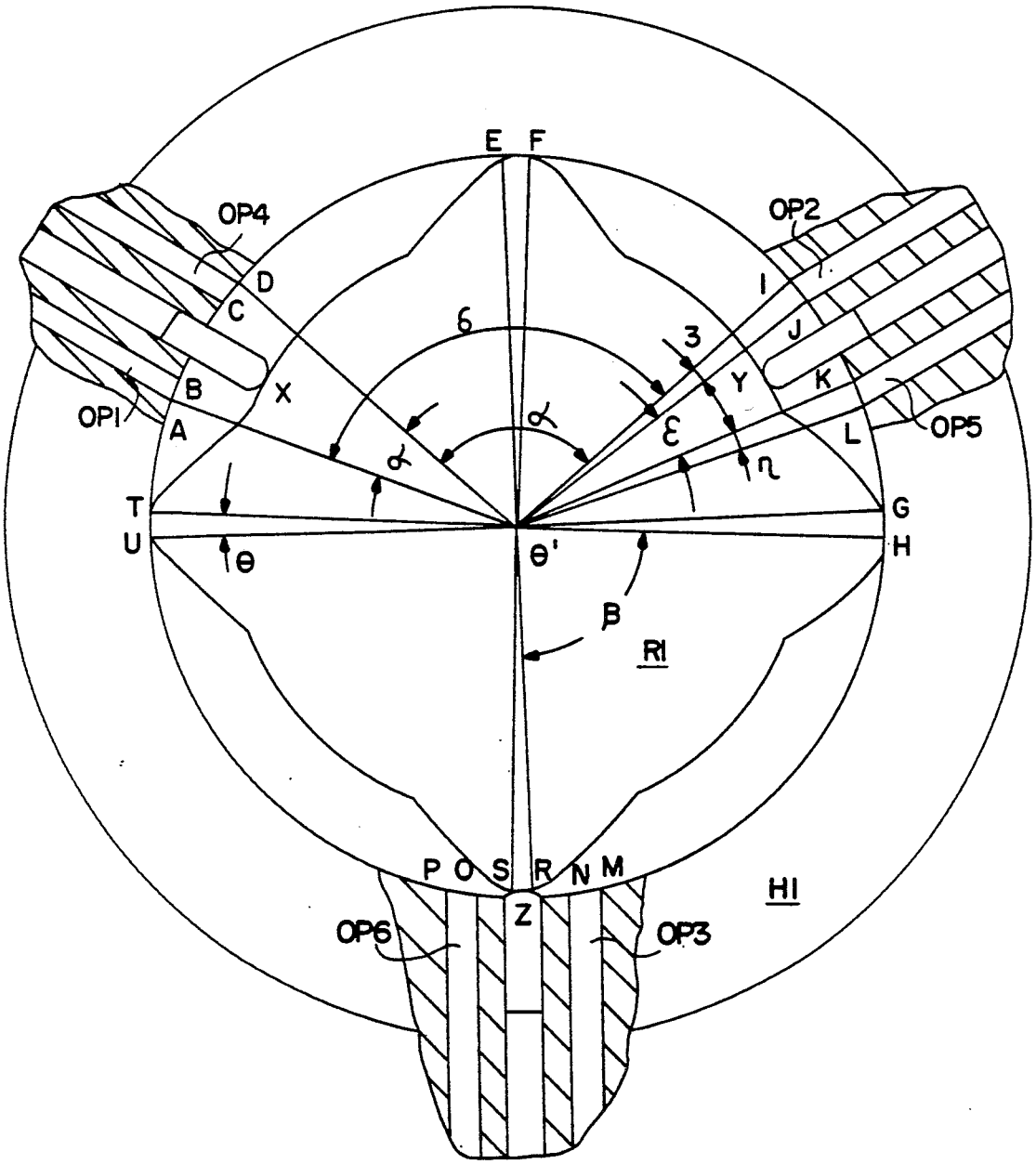
FIG. 7 is a cross-sectional view of a seventh embodiment of a rotary fluid machine in accordance with the teachings of the present invention.
Figure 8:
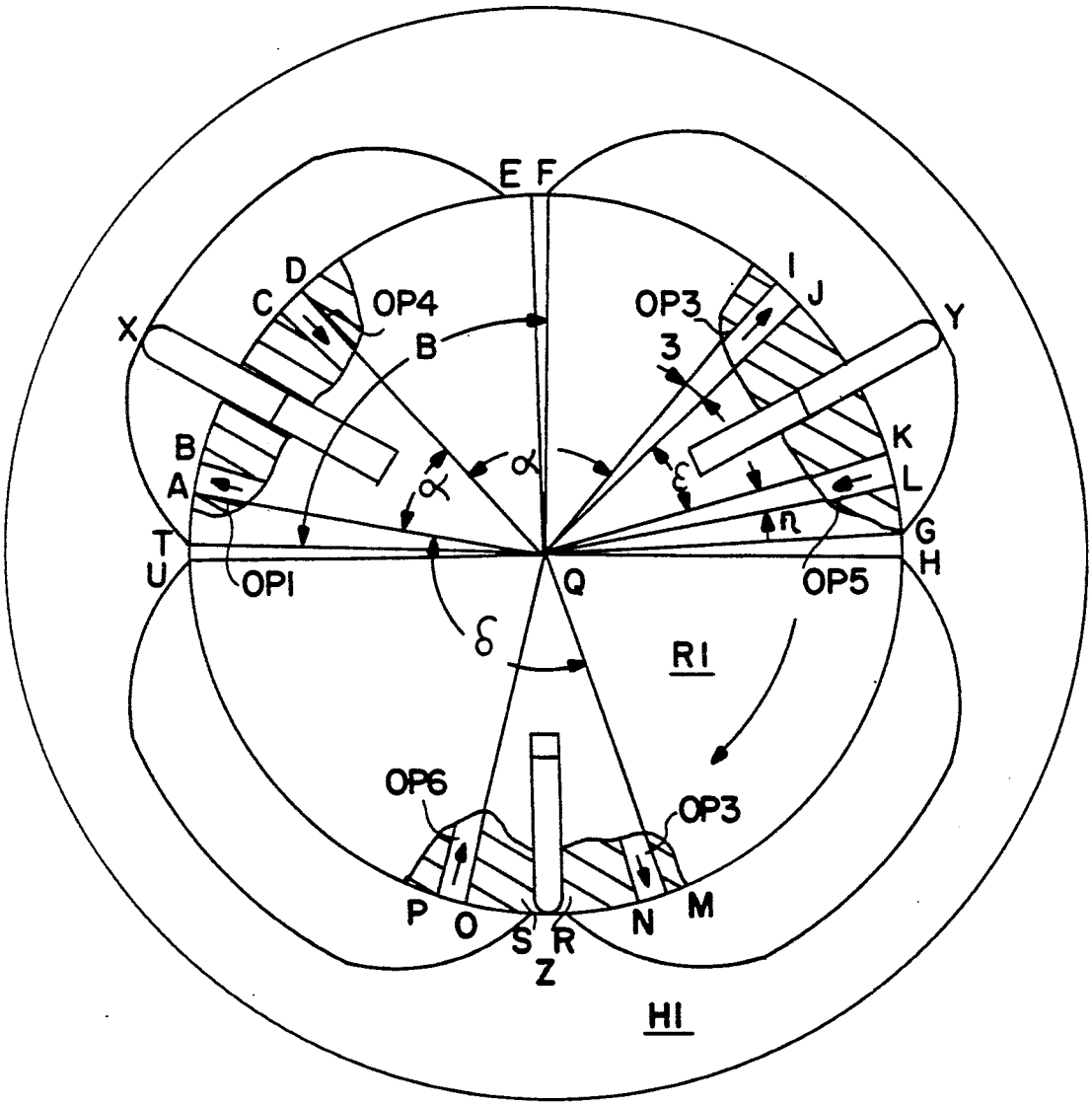
FIG. 8 is a cross-sectional view of an eighth embodiment of a rotary fluid machine in accordance with the teachings of the present invention.

From the above description it should also be apparent that the configuration of the rotary fluid machine of the present invention can be radically changed while still operating in the same manner. In particular, it would be possible to alternately provide the fluid passage openings OP1–OP6 on the housing H1 and the rotor R1. It would further also be possible to provide all of the fluid passage openings OP1–OP6 in the housing. It would also be further possible to provide the lobes in the housing while providing the seals in the rotor. Examples of these variants are shown in FIGS. 7 and 8 and like elements in these figures operate in substantially the same way as the rotary fluid machine of FIG. 6. In addition, in the construction of FIG. 7, since the fluid passage openings OP1–OP6 are provided on the housing, the relationship between the number of lobes and seals reverses. In particular, for this construction, the number of lobes must be greater than or equal to the number of seals plus one.

It should further be apparent from the above description of the Embodiments 6, 7 and 8, when it is operating as a rotary fluid motor, the direction of rotation can be easily reversed or the motor can be easily braked by changing the supply of pressurized hydraulic fluid from one of the grooves G1 to the alternate groove G2 or by providing a restriction in the fluid line from the groove G2.

Figure 9:
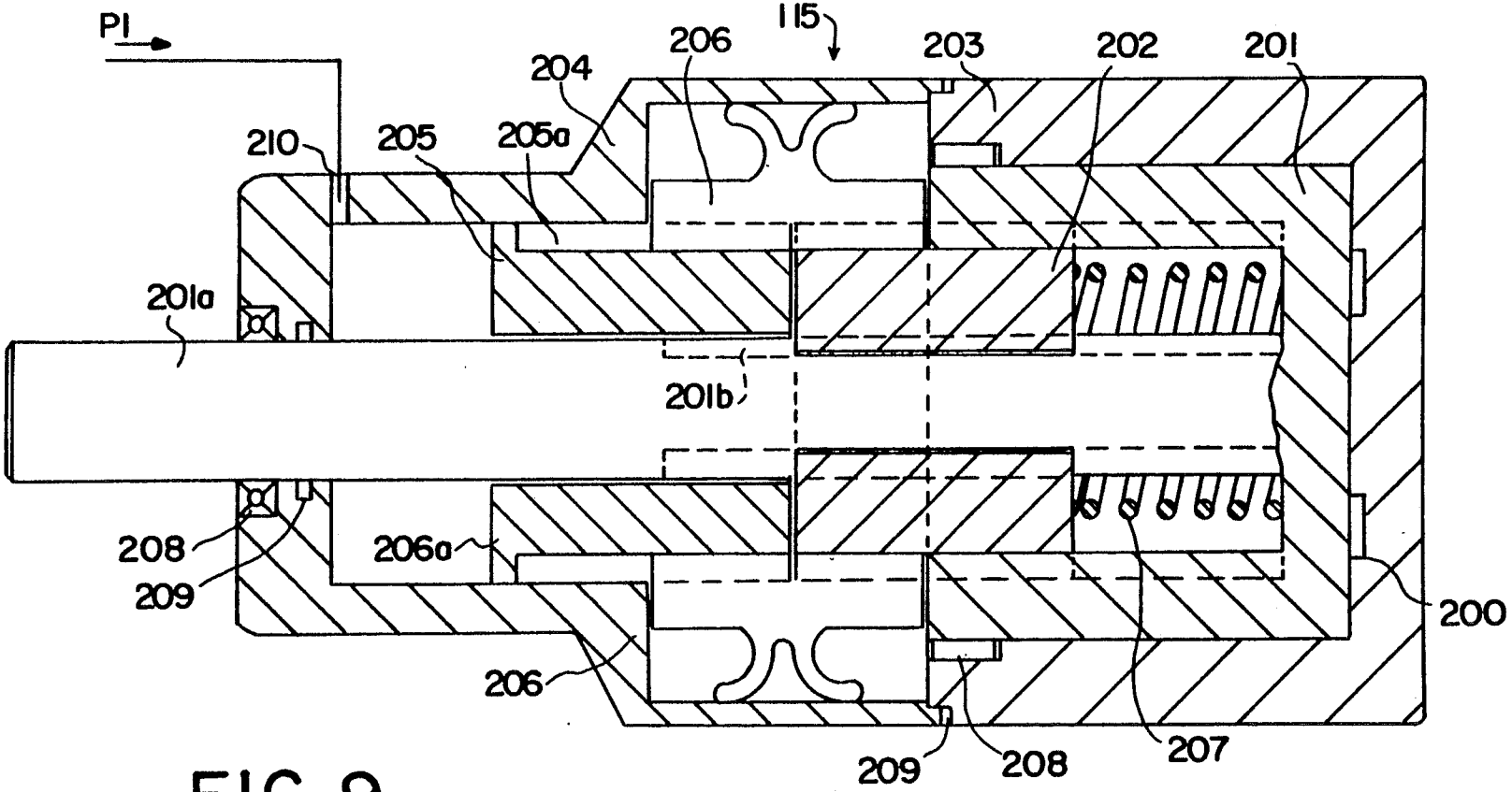
FIG. 9 is a cross-sectional view of a variable rotary fluid machine in accordance with the teachings of the present invention.

Referring to FIGS. 9-11, shown therein is a ninth embodiment of the present invention. In this ninth embodiment, any of the constructions of the first eight embodiments could be used, and the essential improvement of the ninth embodiment is that it provides a variable displacement rotary fluid machine.

Figure 10B:
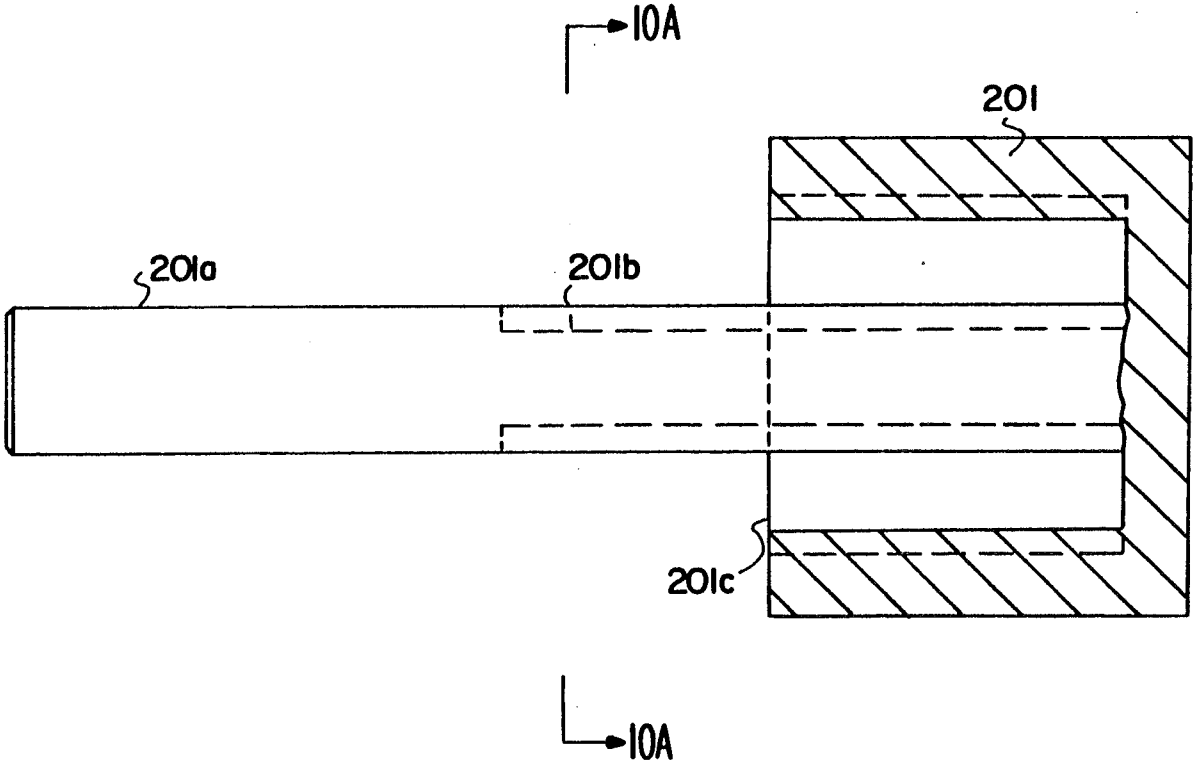
FIG. 10B is a cross-sectional view of FIG. 10A along the line A—A.
Figure 10A:
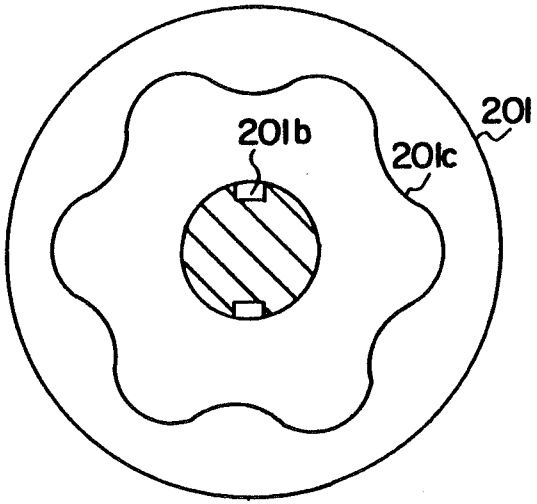
FIG. 10A is a partial cross-sectional view of a rotor of the machine of FIG. 8

The variable displacement rotary fluid machine shown in FIG. 9 is made up of a rotor plug support portion 203 and a seal plug supporting and chamber forming portion 204. These two portions 203 and 204 are coupled together and a gasket 209 is provided therebetween to form a sealed housing. A rotor plug 201 is provided in the rotor plug supporting portion 203. The rotor plug is as shown in FIGS. 10A and 10B and includes a shaft 201*a* which is provided with keyways 201*b* for being keyed to the rotor 202. In addition, the inner surface 201*c* of the rotor plug 201 is substantially of the same shape as the rotor 202 so that the rotor 202 can slide into the rotor plug 201. The rotor plug 201 is further supported within the housing H5 by bearings 208 and the shaft portion 201*a* of the rotor plug 201 is sealed to the rotor plug supporting end chamber forming portion 204 by a gasket 209.

A seal plug 205 is provided within the seal plug supporting and chamber forming portion 204 of the housing H5 and is of substantially the same construction shown in FIGS. 11A and 11B. In particular, the seal plug 205 is of substantially the same shape as the inner surface of the chamber of the rotary fluid machine, which in this case is circular. The seal plug further includes slots 205*a* into which the seals 206 fit and a hole 205*b* which is substantially of the same diameter as the outer diameter of the shaft 201*a* of the rotor plug 201. A spring 207 is further provided between the bottom of the rotor plug 201 and one side of the rotor 202. Also, a fluid port 210 is provided in the seal plug supporting and chamber forming portion 204 so that fluid under pressure can be injected into the space formed between one side of seal plug 205 and the inner surface of the seal plug supporting and chamber forming portion 204 so that the seal plug 205 can be caused to move and in this way force the rotor 202 against the pressure of the spring 207 to move into the rotor plug 201.

In operation, the variable rotary fluid machine of FIG. 9 operates substantially the same as the other four embodiments; however, by injecting pressurized fluid P1 through the port 210 to cause the seal plug 205 to move to the right in the drawings, the rotor 202 is also moved to the right in the drawings to compress the spring 207. In this way, the displacement of the rotary fluid machine can be decreased. Similarly, if the pressure applied via the port 210 is decreased, the rotor 202 together with the seal plug 205 will be moved to the left by the strength of the spring 207 to thereby decrease the displacement of the rotary fluid machine. In this way, the displacement of the variable rotary fluid machine can be changed.

It should also be apparent that the function of the spring 207 could be performed hydraulically by other means and/or that the spring could instead engage against the seal plug 205.

It should be apparent to those skilled in the art that the above-described embodiments are merely illustrative of but a few of the many possible specific embodiments which represent the applications and principles of the present invention. Numerous and various other arrangements can be readily devised by those skilled in the art without departing from the spirit and scope of the present invention.

I claim:

1. A multi-chamber rotary fluid machine comprising:

a plurality of fluid chambers defined by a housing and a rotor and by a plurality of lobes and seals engaging with the lobes provided on the housing and the rotor with the number of seals being greater than or equal to the number of lobes plus one;

a fluid communicating means provided in each of said plurality of chambers with alternate fluid communicating means being coupled together such that fluid is introduced or expelled from all of said plurality of fluid chambers at the same time; and a ring provided between the housing and the rotor with the seals extending through openings in said ring; and wherein:

each of said seals is made up of a plurality of mutually slideable thin plates with a length of a diagonal line defined by two opposite sealing points on each of said thin plates of each of said seals set such that the diagonal line is equal to a radial distance between an outer surface of the rotor and an inner surface of the housing.

2. A rotary fluid machine according to claim 1, wherein said lobes are provided on said rotor and said fluid communicating means are provided on said lobes.

3. A rotary fluid machine according to claim 1, wherein said lobes are provided on said rotor and said fluid communicating means are provided in said housing.

4. A rotary fluid machine according to claim 1, wherein said lobes are provided in said housing and said fluid communicating means are provided in said lobes.

5. A rotary fluid machine according to claim 1, wherein said lobes are provided on said housing and said fluid communicating means are provided in said rotor.

6. A rotary fluid machine according to claim 1, further comprising lobes provided on both the housing and the rotor.

7. A rotary fluid machine according to claim 1 wherein:

$$\beta \leqq \alpha + \theta$$

$$Z_L = Z_L'$$

$$x = \frac{360}{2Z_L} = \frac{360}{2Z_L'} = \frac{\delta}{2}$$

wherein:

$\delta$ = the angle between successive lobes;

$\times$ = the angle between a lobe on said rotor and a successive lobe on said housing;

$Z_L$ = the number of lobes on said rotor;

$Z_L$ = the number of lobes on said housing;

$\theta$ = the angular width of a vane;

$\alpha$ = the angle between successive inlet and outlet fluid communicating means provided on different lobes;

$\beta$ = the angle between successive vanes.

* * * * *